US006842594B2

(12) United States Patent
Frankel

(10) Patent No.: US 6,842,594 B2
(45) Date of Patent: Jan. 11, 2005

(54) INTERMITTENT DC BIAS CHARGE ROLL AC CLEANING CYCLE

(75) Inventor: Neil A. Frankel, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 45 days.

(21) Appl. No.: 10/319,200

(22) Filed: Dec. 13, 2002

(65) Prior Publication Data

US 2004/0114949 A1 Jun. 17, 2004

(51) Int. Cl.[7] ..... G03G 15/00

(52) U.S. Cl. ..... 399/89; 399/100; 399/314; 361/225

(58) Field of Search ..... 399/89, 100, 101, 399/176, 313, 314, 50, 66, 174; 361/225, 230, 235

(56) References Cited

U.S. PATENT DOCUMENTS 4,851,960 A 7/1989 Nakamura et al. ..... 361/225
5,164,779 A * 11/1992 Araya et al. ..... 399/176
5,412,455 A 5/1995 Ono et al.
5,613,173 A 3/1997 Kunzmann et al. ..... 399/89
5,649,268 A * 7/1997 Maebashi et al. ..... 399/168
6,035,163 A 3/2000 Zona et al. ..... 399/176
6,047,145 A * 4/2000 Shigezaki et al. ..... 399/50
6,408,145 B1 * 6/2002 Ohki ..... 399/50

FOREIGN PATENT DOCUMENTS

JP 06202494 A * 7/1994 ..... G03G/15/16
JP 11149205 A * 6/1999 ..... G03G/15/02
JP 2002062716 A * 2/2002 ..... G03G/15/02

* cited by examiner

*Primary Examiner*—Robert Beatty
(74) *Attorney, Agent, or Firm*—Richard F. Spooner

(57) ABSTRACT

An apparatus for applying an electrical charge to a charge retentive surface, wherein a bias charge roll member is situated proximately to a surface to be charged such as, a photoreceptor. The bias contact roll member is supplied with an electrical bias including an oscillating voltage signal having, in one mode of operation, a clipped AC input voltage and in a second mode, an unclipped AC input voltage.

22 Claims, 4 Drawing Sheets

INTERMITTENT DC BIAS CHARGE ROLL AC CLEANING CYCLE

CROSS-REFERENCE TO RELATED APPLICATIONS

Reference is made to commonly-assigned copending U.S. patent application Ser. No. 10/319,172, filed herewith, entitled INTERMITTENT DC BIAS CHARGE ROLL WITH DC OFFSET VOLTAGE, by Facci, et al, the disclosure(s) of which are incorporated herein."

FIELD OF THE INVENTION

The present invention relates generally to a roller apparatus for generating a substantially uniform charge on a surface, and, more particularly, concerns a biased roll charging apparatus having, in one mode of operation, a clipped AC input voltage, primarily for use in electrostatographic applications and in a second mode, an unclipped AC input voltage.

BACKGROUND AND SUMMARY

When used to charge an imaging member, a roller used to create a charge on another surface or substrate is commonly referred to as bias charge roll ("BCR"). When used to charge a substrate to enable transfer of a developed image from an imaging member to a substrate member, a roller used to create such bias charging is commonly referred to as a bias transfer roll ("BTR"). Although both may differ in details particular to their applications, both represent illustrative embodiments of the present invention.

Generally, the process of electrostatographic reproduction is initiated by substantially uniformly charging a photoreceptive member, followed by exposing a light image of an original document thereon. Exposing the charged photoreceptive member to a light image discharges a photoconductive surface layer in areas corresponding to non-image areas in the original document, while maintaining the charge on image areas for creating an electrostatic latent image of the original document on the photoreceptive member. This latent image is subsequently developed into a visible image by a process in which a charged developing material is deposited onto the photoconductive surface layer, such that the developing material is attracted to the charged image areas on the photoreceptive member. Thereafter, the developing material is transferred from the photoreceptive member to a copy sheet or some other image support substrate to which the image may be permanently affixed for producing a reproduction of the original document. In a final step in the process, the photoconductive surface layer of the photoreceptive member is cleaned to remove any residual developing material therefrom, in preparation for successive imaging cycles.

The above described electrostatographic reproduction process is well known and is useful for both digital copying and printing as well as for light lens copying from an original. In many of these applications, the process described above operates to form a latent image on an imaging member by discharge of the charge in locations in which light from a lens, laser, or LED discharges a charge. Such printing processes typically develop toner on the discharged area, known as DAD, or "write black" systems. Light lens generated image systems typically develop toner on the charged areas, known as CAD, or "write white" systems. The embodiments of the present invention apply to both DAD and CAD systems.

With respect to BCR applications, those skilled in the art recognize that various devices and apparatus have been proposed for creating a uniform electrostatic charge or charge potential on a photoconductive surface prior to the formation of the latent image thereon. Generally, corona generating devices are utilized to apply a charge to the photoreceptive member. In a typical device, a suspended electrode, or so-called coronode, comprising a thin conductive wire is partially surrounded by a conductive shield with the device being situated in close proximity to the photoconductive surface. The coronode is electrically biased to a high voltage potential, causing ionization of surrounding air which results in the deposit of an electrical charge on an adjacent surface, namely the photoconductive surface of the photoreceptive member. Corona generating devices are well known, as described, for example, in U.S. Pat. No. 2,836,725, to R. G. Vyverberg, among numerous other patents and publications. In the referenced Vyverberg patent, the coronode is provided with a DC voltage, while the conductive shield is usually electrically grounded and the photoconductive surface to be charged is mounted on a grounded substrate, spaced from the coronode opposite the shield. Alternatively, the corona device may be biased in a manner taught in U.S. Pat. No. 2,879,395, wherein the flow of ions from the electrode to the photoconductive surface is regulated by an AC corona generating potential applied to the conductive wire electrode and a DC potential applied to the conductive shield partially surrounding the electrode. The DC potential allows the charge rate to be adjusted, making this biasing system ideal for self-regulating systems. Various other corona generating biasing arrangements are known in the art and will not be discussed in great detail herein.

Several problems have historically been associated with corona generating devices. One problem includes the use of very high voltages (3000–8000 V), requiring the use of special insulation, inordinate maintenance of corotron wires, low charging efficiency, the need for erase lamps and lamp shields and the like, arcing caused by non-uniformities between the coronode and the surface being charged, vibration and sagging of corona generating wires, contamination of corona wires, and, in general, inconsistent charging performance due to the effects of humidity and airborne chemical contaminants on the corona generating device. More importantly, corotron devices generate ozone, resulting in well-documented health and environmental hazards. Corona charging devices also generate oxides of nitrogen which eventually desorb from the corotron and oxidize various machine components, including the photoreceptor, resulting in an adverse effect on the quality of the final output print produced thereby.

As an alternative to corona generating devices used in charging systems, roll charging systems such as, BCR's and BTR's have been developed and incorporated into various machine environments with limited success. BCR charging systems are exemplified by U.S. Pat. No. 2,912,586, to R. W. Gundlach; U.S. Pat. No. 3,043,684, to E. F. Mayer; U.S. Pat. No. 3,398,336, to R. W. Martel et al.; U.S. Pat. No. 3,684,364, to F. W. Schmidlin; and U.S. Pat. No. 3,702,482, to Dolcimascolo et al., among others, wherein an electrically biased charging roller is placed in contact with the surface to be charged, e.g. the photoreceptive member. Also relevant is U.S. Pat. No. 5,412,455, to Ono et al. wherein a charging device includes: a member to be charged; a charging member connectable to the member to be charged; a power source for supplying an oscillating voltage to the charging member; and a constant voltage element connected electrically in parallel with the power source for generating the oscillating voltage. Also, U.S. Pat. No. 5,463,450, to Inoue et al. discloses a charging apparatus for electrically charging a member to be charged including a charging member contactable to the member to be charged. The member to be charged includes a core and a voltage source for applying an oscillating voltage between the member to be charged and the charging member, wherein the frequency of the oscillating voltage satisfies a predetermined condition. Each of these is hereby incorporated by reference in their entirety.

In BTR charging systems, DC voltage is typically used. DC voltage attracts dirt, however, especially toner in spaces void of printing substrates, such spaces comprising inter-document zones, areas exposed when printing on less-than-full-width printing media, and similar areas in which the BTR is directly exposed to the charge carrying member or intermediate transfer member. Paper debris is also another contaminant of BTR systems. In response, conventional BTR apparatus require brushes to remove dirt and debris. Such brushes, however, add cost and complexity, occupy valuable space, and require maintenance when clogged or filled with dirt.

In BCR charging systems, a charging member in the form of a roller is contacted with the surface of the photoreceptive member or other member to be charged, and an oscillating input voltage, typically a DC biased AC voltage signal, is applied to the roller to generate an oscillating electric field for applying a charge potential of a given polarity, to the photoreceptive member where the DC offset defines the polarity of the charge applied. Although the input voltage may be comprised solely of a DC component, an oscillating voltage such as, an AC voltage signal having a DC voltage signal superimposed thereon has been found to be preferable with respect to charge uniformity. See, e.g., U.S. Pat. No. 4,851,960 to Nakamura et al which teaches that peak-to-peak input voltage, Vp-p, for DC-biased AC wave form should be twice the charge starting voltage for the photoreceptor or other charge receptor in the system being charged.

The absence of charge uniformity tends to manifest itself in the form of periodic stripes or so-called strobing corresponding to the variation in charge potential on the photoconductive surface. This strobing effect causes variations in toner attraction during development and often results in significant image quality degradation. However, an oscillating input voltage contributes both positive and negative polarity charge to the photoconductive surface. This results in a charging system that requires relatively high charging currents which, in turn, has a negative effect on the functional life of the photoreceptive member. Thus, a significant disadvantage of most biased roll charging systems is the resulting rapid wear of the photoconductive surface caused by the electrical discharge from the bias charge roll during the charging process. A related cause for rapid wear appears to be chemical degradation of organic and other complex molecules coupled with repetitive wiping or scraping of the photoreceptor layers by cleaning blades or other cleaning members.

One partial solution to the above problems is found in U.S. Pat. No. 5,613,173, issued to Kunzmann et al., hereby incorporated by reference in its entirety. In Kunzmann, a BCR apparatus is disclosed having clipped AC input voltage to reduce the phenomenon of strobing while also reducing photoreceptor wear caused by the electrical discharge from the bias charge roll during the charging process. The clipping of the AC oscillating voltage removes one polarity from the input signal, thereby supplying a single polarity to the photoreceptor or other charged member and, as a result, enabling sufficient charging at lower voltages applied to the charged surface. Such lower voltages extend photoreceptor life, in part by reducing electrically induced chemical damage.

Although the solution of Kunzmann improves photoreceptor wear, elimination of an AC oscillating voltage leaves only DC voltage, and DC-only voltage attracts dirt such as, toner particles, dust, and paper debris. One solution is to add cleaning apparatus such as, brushes and cleaning blades. These, however, add cost, complexity, and maintenance issues. What is needed is a system that retains the improved durability advantages of a single polarity waveform as well as the cleaning advantages of a multiple polarity waveforms.

In accordance with one embodiment of the present invention, an apparatus for applying an electrical charge to a member to be charged is provided, said charging apparatus comprising: a power supply for supplying an oscillating voltage signal; a charge roll member situated in proximity to a surface of the member to be charged; and a switch for switching between a plurality of modes wherein: (a) in a first mode, an electrical bias is applied from the power supply to the charge roll member, the electrical bias including a single polarity input drive voltage to said charge roll member; and (b) in a second mode, an electrical bias is applied from the power supply to the charge roll member, the electrical bias including an oscillating voltage signal containing multiple polarity components in order to supply oscillating polarity input drive voltage to the charge roll member.

In accordance with another embodiment of the invention, an electrophotographic imaging system is provided, said imaging system comprising: an apparatus for applying an electrical charge to a member to be charged, said charging apparatus comprising: a power supply for supplying an oscillating voltage signal; a charge roll member situated in proximity to a surface of the member to be charged; and a switch for switching between a plurality of modes wherein: (a) in a first mode, an electrical bias is applied from the power supply to the charge roll member, the electrical bias including a single polarity input drive voltage to said charge roll member; and (b) in a second mode, an electrical bias is applied from the power supply to the charge roll member, the electrical bias including an oscillating voltage signal containing multiple polarity components in order to supply oscillating polarity input drive voltage to the charge roll member.

In accordance with another embodiment of the invention, a process for applying an electrical charge to a member to be charged is presented, said process comprising: supplying an oscillating voltage signal from a power supply; positioning a charge roll member proximately to a surface of the member to be charged; and selecting between a plurality of modes, wherein: in the first mode, an electrical bias is applied from the power supply to the charge roll member, the electrical bias including a single polarity input drive voltage to said charge roll member; and in a second mode, an electrical bias is applied from the power supply to the charge roll member, the electrical bias including an oscillating voltage signal containing multiple polarity components in order to supply oscillating polarity input drive voltage to the charge roll member.

BRIEF DESCRIPTION OF THE DRAWINGS

These and other aspects of the present invention will become apparent from the following description in conjunction with the accompanying drawings in which.

DESCRIPTION

Figure 1:
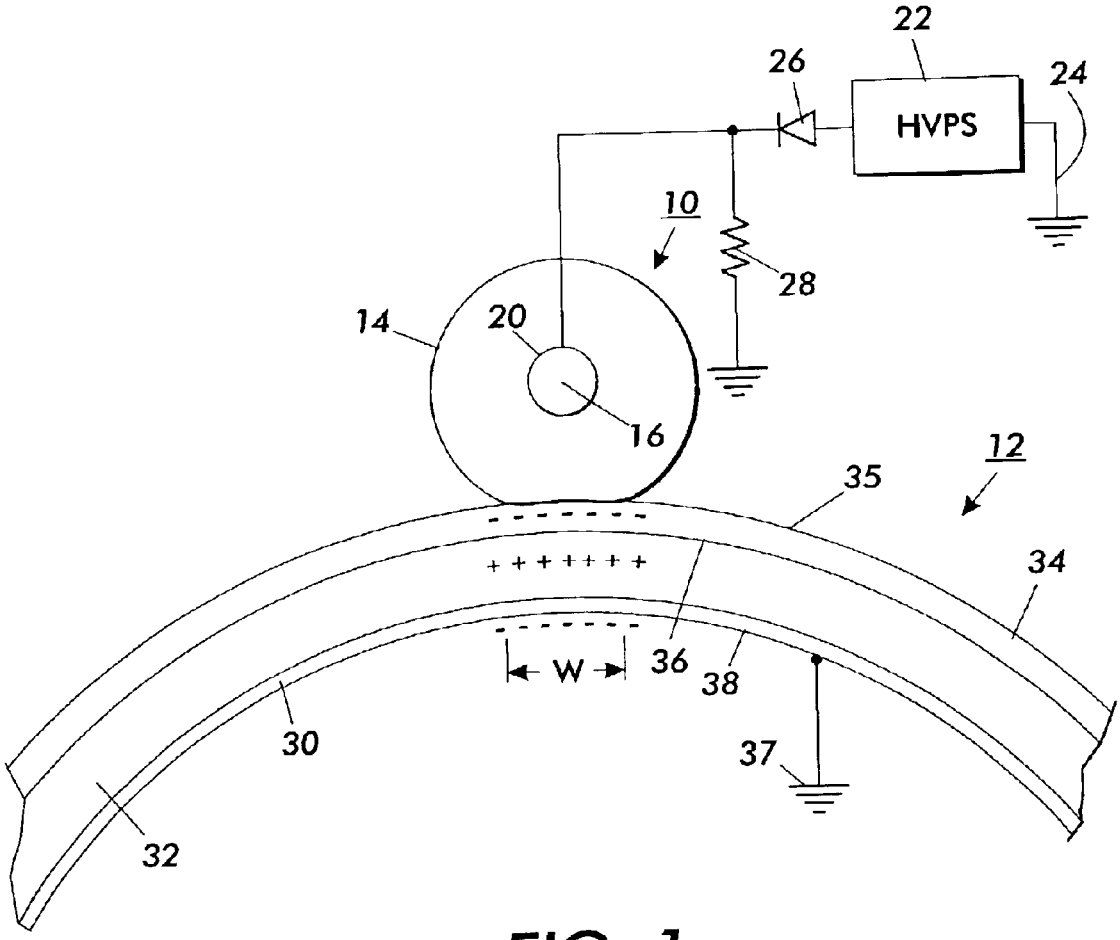
FIG. 1 PRIOR ART
FIG. 1 is a partial schematic view of a biased roll charging system in accordance with the prior art and showing the electrostatic operation of the system.

For a general understanding of the present invention, reference is made to the drawings. In the drawings, like reference numerals have been used throughout to designate identical elements.

It will be recognized, that while the present invention describes a charging system for a typical BCR used in an electrostatographic printer, embodiments of the present invention are equally well suited for use in a wide variety of other electrostatographic-type processing machines, in BTR applications, and in other applications in which uniform charges are to be placed upon moving surfaces. The disclosed invention is not limited in its application to the particular embodiment or embodiments shown herein. In particular, it should be noted that the charging apparatus of the present invention, described with reference to an exemplary charging system, may also be used in a transfer, detack, or cleaning subsystem of a typical electrostatographic apparatus since such subsystems may also require the use of a charging device. In addition, it will be recognized that the disclosed biased roll charging system may have equal application for applying an electrical charge to a member other than a photoreceptor and/or in environments outside the realm of electrostatographic printing.

Referring initially to FIG. 1, one embodiment of a biased roll charging system is shown in the context of an exemplary electrostatographic reproducing apparatus, employing a drum 12 including a photoconductive surface 35 deposited on an electrically grounded conductive substrate 38. A motor (not shown) engages with drum 12 for rotating the drum 12 to advance successive portions of photoconductive surface 35 through various processing stations disposed about the path of movement thereof, as is well known in the art. Initially, a portion of drum 10 passes through a charging station where a charging device in accordance with the present invention, indicated generally by reference numeral 10, charges the photoconductive surface on drum 12 to a relatively high, substantially uniform potential.

Referring now, more particularly, to the bias roll charging system 10, a conductive roll member 14 is provided in contacting engagement with the photoreceptor member 12. The conductive roll member 14 is axially supported on a conductive core or shaft 20, situated transverse to the direction of relative movement of the photoreceptor member 12. In one embodiment, the roll member 14 is provided in the form of a deformable, elongated roller supported for rotation about an axis 16 and is preferably comprised of a polymer material such as, for example, neoprene, E.P.D.M. rubber, Hypalon® rubber, nitrile rubber, polyurethane rubber (polyester type), polyurethane rubber (polyether type), silicone rubber, Viton®/Fluorel® rubber, epichlorohydrin rubber, or other similar materials having a DC volume resistivity in the range of $10^3$ to $10^7$ ohm-cm after suitable compounding with carbon particles, graphite or other conductive additives. These materials are chosen for the characteristic of providing a deformable structure while in close proximity or contact with the photoreceptor member, as well as wearability, manufacturability and economy. The deformability of the roller member 14 is important to provide a nip having a substantially measurable width while being engaged with the photoreceptor 12.

A high voltage power supply 22 is connected to roll member 14 via shaft 20 for supplying an oscillating input drive voltage to the roll member 14. While it is possible to use a standard line voltage, other voltage levels or voltage signal frequencies may be desirable in accordance with other limiting factors dependent on individual machine design such as, the desired charge level to be induced on the photoreceptor or the speed of imaging operations desired. The oscillating input voltage and circuit connecting the power supply 22 to shaft 20 is discussed in greater detail below.

With particular regard to biased roll charging, a suitable photoreceptive member 12 has the property of injecting a single sign of mobile carriers from a charge generating layer into a charge transport layer such that, a surface charge potential having only a single charge polarity is generated on the surface of the photoreceptor member, irrespective of the inducing voltage signal applied to roll member 14. With reference to FIG. 1, the photoreceptive member 12 generally includes a conductive substrate 38, such as, an aluminum sheet connected to a ground potential 37, a charge generating layer 30, a charge transport layer 32 comprising a photoconductive insulator such as, selenium or any of a variety of organic compositions, and a overcoating 34, forming the outer surface 35 of the photoreceptor member.

The charging operation involves the application of the AC voltage signal from the bias charging system 10 to the photoconductive surface of photoreceptor 12, which creates a voltage potential across the photoreceptor to ground 37. Charge carriers from the charge generating layer 30 migrate into the bulk of the charge transport layer 32 to the upper surface 36 of the photoconductive material, where the charge will be trapped. When the AC voltage signal from voltage source 22 is of a negative polarity, as indicated by the minus signs (−) along the lowermost portion of roller member 14, in contact with the outer surface 35 of photoreceptor member 12, a positive charge indicated by plus signs (+) is induced near the upper surface 36 of the photoconductive material layer, suitable for charging the photoreceptor member in preparation for imaging. A thin dielectric overcoating 34 is desirable on either the roller member 14 or the photoreceptor 12 for a variety of reasons, including protection of the surfaces of roller member 14 or photoreceptor 12, or for a current limiting action which may allow the use of low resistivity rollers, or for photoreceptor or roll member surface property control, and especially because the use of an overcoating allows operation of the device below typical corona thresholds, and so avoids strobing due to exit corona, as will be discussed. In the embodiment shown in the drawings, overcoating 34 is provided on the upper surface of the photoreceptor. Alternatively, an overcoating may be provided on the outer surface of bias roll member 14 for the same effect.

Strobing (i.e. successive areas of varying voltage characteristics), has at least two causes. It can be caused by inducing a charge on a first photoreceptor surface portion by providing roller member 14 in contact with that portion during a period of the AC voltage signal passing through a selected polarity, while in a succeeding photoreceptor surface portion, inducing no charge because the AC voltage signal is passing through a period of non-selected polarity while roller member 14 is in contact with that portion of the photoreceptor surface. Accordingly, in order to provide a uniform charge on the photoreceptor surface, each incremental portion of the photoreceptor member surface must be contacted during a period of charging, or a period wherein the polarity of the driving voltage is of the selected polarity for charging. Thus, a given area of the rubber roller 14, the nip, should be maintained in contact with any selected surface portion for a period greater than the period of the driving voltage frequency. Varying nip widths may be provided by varying the materials used for the roller. In most cases, the allowable relative speed of the bias roller and the photoreceptor surface is varied in compensation for the varied nip width to prevent strobing. It will, of course, be appreciated that the time required for charging a photoreceptor to a given voltage level depends on the physics of the charge transfer process. In other words, charging for a predetermined period is sufficient to charge the photoreceptor to a desired voltage level.

Strobing may also occur if the combination of induced and applied charges causes the field in the exit portion of the nip to exceed the typical corona threshold. That is, in the area of the exit nip, air breakdown may occur, resulting in deposit of surface charges on the roller and the photoreceptor. The amount of surface charge will be modulated by the AC applied voltage. If this occurs, strobing may be eliminated by making the overcoating thicker or reducing the peak applied voltage.

U.S. Pat. No. 5,613,173, issued to Kunzmann and discussed above, discusses the problems resulting from using a simple DC offset AC waveform from power supply 22 to shaft 20. Specifically, the use of a simple AC waveform contributes both positive and negative charge to the photoreceptor member. Since the photoreceptive member 12 has the property of injecting only a single sign of mobile carriers from a charge generating layer to induce the generation of only a single charge polarity, a relatively high DC offset bias charge roll current is required in order to create a current with only one polarity. The high DC bias current, however, results in degradation and rapid wear of the photoreceptor charge transport layer due to the electrical discharge of the bias charge roller as the photoreceptor member is being charged. The solution in Kunzmann is to clip, or rectify, the AC current, thereby providing a single polarity oscillating input drive voltage supplied to the bias charge roller. This approach allows a reduced total applied voltage to the bias roll system without limiting the resulting surface charge potential and its uniformity.

One specific embodiment described in Kunzmann is incorporated within the prior art circuit shown in FIG. 1. In this embodiment, a simple diode/resistor circuit 26, 28 is coupled to the high voltage power supply 22 for eliminating the positive component of the DC offset AC waveform provided by power supply 22 without the need for a DC offset signal. This diode/resistor circuit acts as a rectifier circuit for eliminating or clipping the positive component of the oscillating AC voltage signal. As explained in Kunzmann, an exemplary embodiment in the art prior to Kunzmann comprises a bias charge roll input drive voltage having a peak-to-peak voltage of 1.6 kilovolts with a DC offset of minus 350 volts at a frequency of 400 hertz. Such an input drive signal will result in 450 volts of positive charge and 1150 volts of negative charge. The resulting photoreceptor surface potential approximates minus 330 volts. By clipping the positive component of this typical AC input waveform, aggregate current flow to the surface of the photoreceptor can be reduced while maintaining required voltage levels. Such decreased current flow decreases the degradation and wear of the charge transport layer of photoreceptor member 12.

Figure 2:
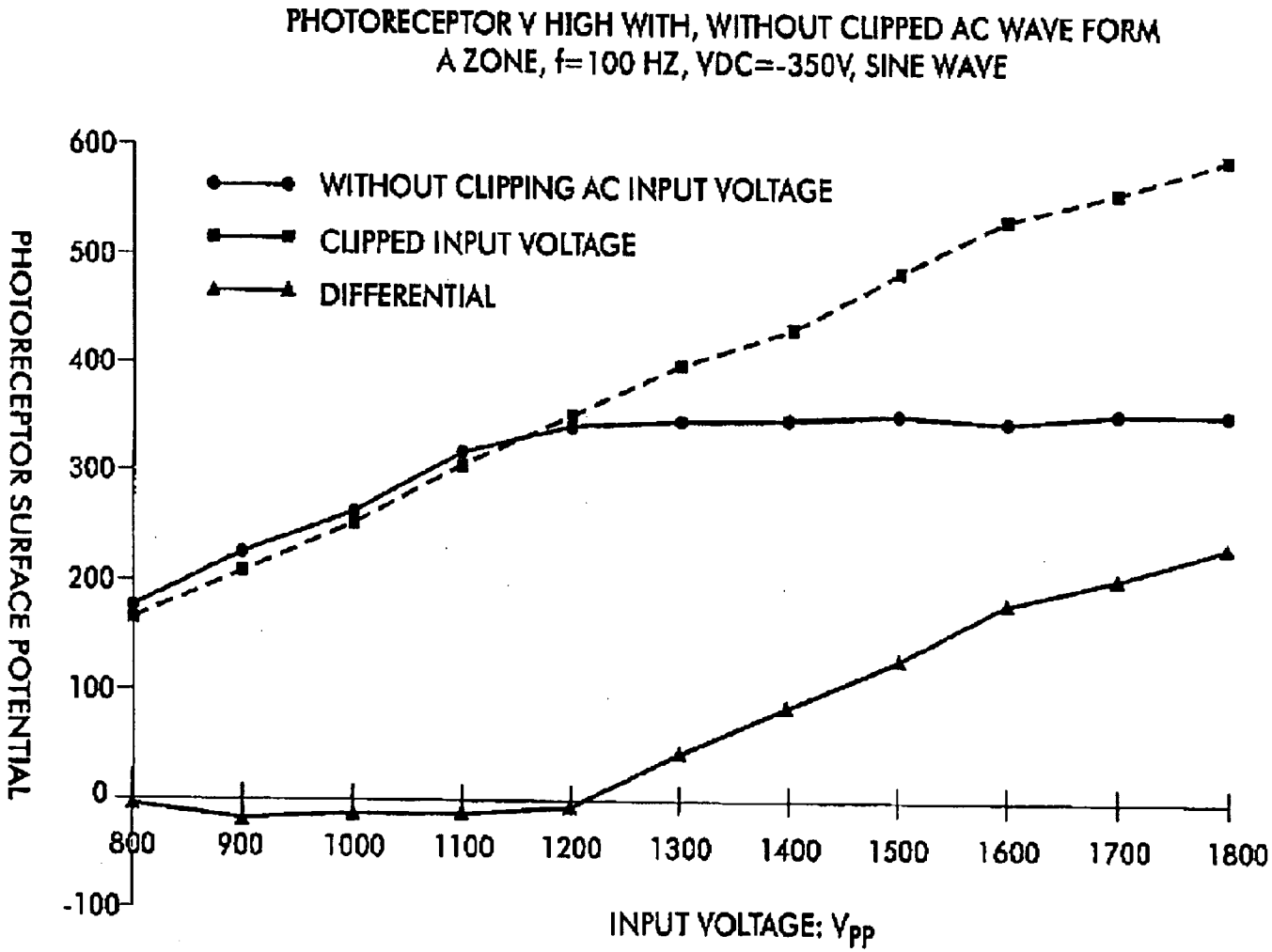
FIG.2 PRIOR ART
FIG. 2 is a graphical representation of the surface potential differential that can be achieved by the bias roll charging system of the present invention [strictly speaking, this figure deals with the Kunsmann et al patent, and the present invention makes sure that the BCR stays clean] relative to a conventional bias charge roll charging system using a non-clipped oscillating input voltage signal.

Turning now to FIG. 2, copied from Kunzmann, the surface potential on the photoreceptor is graphed as a function of both a clipped and unclipped AC input voltage Vp-p. As shown, the surface potential can be increased over conventional AC waveforms in relation to an increase in the peak-to-peak input voltage. In a conventional bias charge roll charging system using a non-clipped oscillating input voltage signal, the surface potential generated on the photoreceptor tends to level off (at approximately 350 volts in FIG. 2) notwithstanding the continued increase in peak-to-peak input voltage. By contrast, in accordance with the invention in Kunzmann, the surface potential generated by a bias charge roll charging system using a clipped oscillating input voltage signal continues to increase as a function of the peak-to-peak input voltage, such that the leveling off characteristic described above with respect to a non-clipped oscillating input voltage signal is eliminated. In this manner, an increased surface potential can be generated on the photoreceptor with a reduced current flow into the photoreceptor when compared to a conventional bias charge roll charging system using a non-clipped oscillating input voltage signal.

While the bias charge system taught by Kunzmann succeeds in lowering damaging high input voltages and resulting highly charged corona around the bias charging system, it exacerbates the need to clean the bias charging system. Specifically, DC-only bias charge systems attract and maintain lint, dirt, toner, and paper debris. The same is also true with respect to DC-biased AC bias charge systems in which the DC-bias results in a charge of constant polarity. The result is that in either the system proposed by Kunzmann or in a constant polarity DC-biased charging system, additional cleaning systems are required. These cleaning systems typically comprise brushes or blades that scrape across the surface of the bias charge roller and clean the roller either entirely through mechanical brushing or scraping or by a combination of mechanical brushing/scraping and attraction of dirt by carrying a charge of opposite polarity from the bias charge roller itself. Regardless of the type of cleaning system, the added components add cost, complexity, and require additional space within a printer compartment. Worse, mechanical brushing or scraping inevitably wears the surface of the bias charge roller itself, thereby shortening its useful life and causing its electrical charging characteristics to drift over time.

Figure 3:
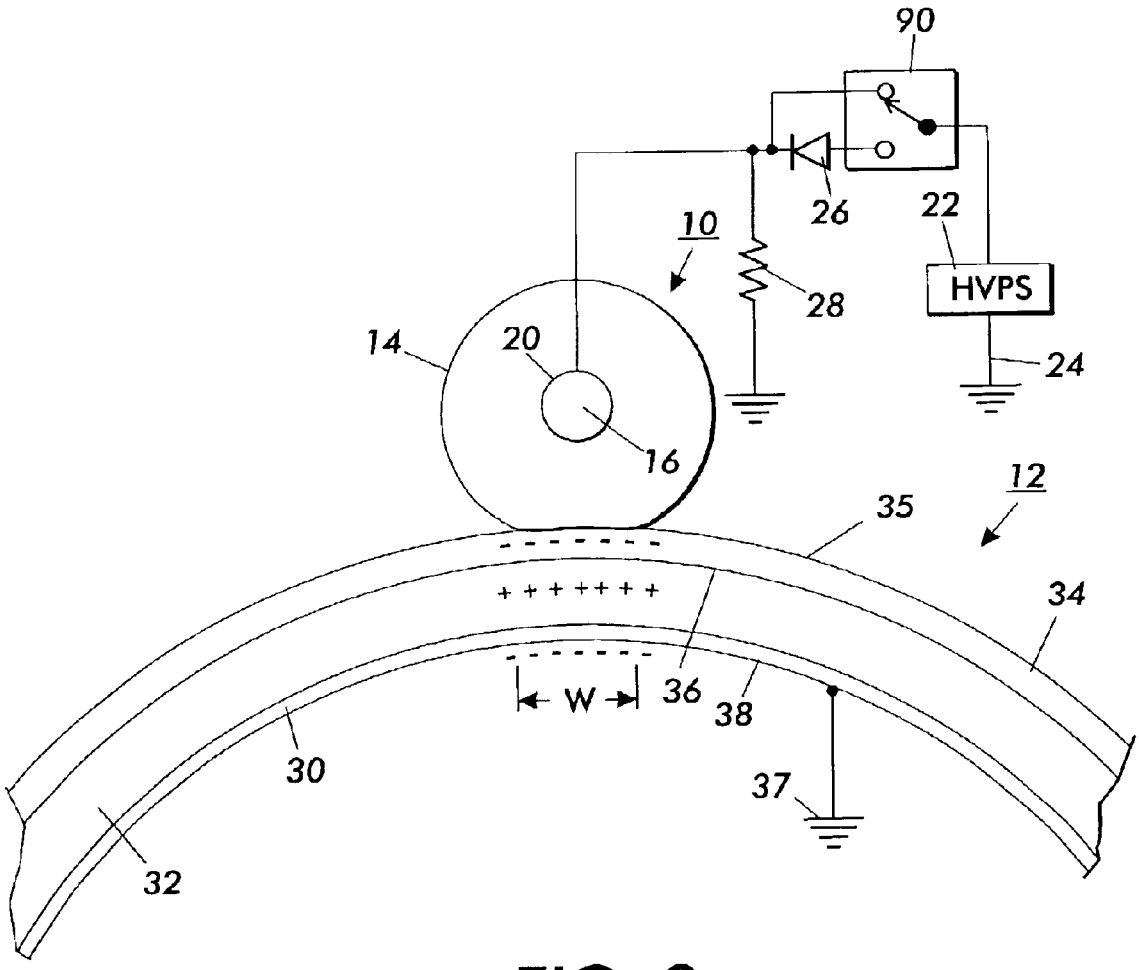
FIG. 3 is a partial schematic view of a biased roll charging system in accordance with one embodiment of the present invention.

Accordingly, one embodiment of the present invention comprises a system that combines the cleaning advantages of (i) conventional AC only or multi-polarity DC-biased AC wave form charging systems with (ii) the lower voltage advantages of rectified oscillating DC-only wave forms. Turning now to FIG. 3, one embodiment of a bias charging system of the present invention is shown. Most features are identical to the prior art bias charging system in FIG. 1 and are labeled accordingly. The circuit connecting high voltage power supply to shaft 20, however, differs. Specifically, switch 90 is interposed between high voltage power supply 22 and rectifier 26. In one mode, switch 90 completes the circuit through rectifier 26 during normal imaging cycles. This results in all of the advantages set forth in Kunzmann, discussed above. In a second mode activated during system warm-up and shutdown cycles and at least periodically during non-imaging periods, switch 90 circumvents rectifier 26 to deliver conventional multi-polarity AC or DC-biased AC current to bias charge system 10. The result is a cleaning cycle during non-imaging periods. Such cleaning cycle is accomplished without any extra cleaning apparatus other than switch 90. Brushes and blades that add complexity and that can scrape and scratch the bias charge roller can be eliminated. This embodiment of the present invention saves cost and complexity while increasing reliability.

An alternative embodiment of the present invention incorporates a two-level DC-bias capability into high voltage power supply 22. During the cleaning mode, the DC bias may be set to zero to avoid charging the photoreceptor. During imaging periods where the AC signal is clipped, a DC bias of desired intensity may be supplied from the high voltage power supply 22.

Those skilled in the art recognize that switch 90 can comprise any of a large number of switching mechanisms commonly used in office-type equipment. Examples include conventional single pole, single throw switches, solid state switches, and solid state or electromechanical relays. In one embodiment, switch 90 operates in its first DC-only mode only during imaging cycles. At all other times, switch 90 operates in its multi-polarity AC waveform mode. The system controller (not shown) identifies whether the system is in its imaging mode or non-imaging mode and issues software commands directing switch 90 to open and close circuits in order to complete the circuit to either the DC-only mode or the AC waveform mode.

In another embodiment, switch 90 opens the circuit to AC waveform current during timed periods triggered by certain machine events such as, system warm-up, shut-down, end of an imaging sequence, or system idleness for a specified period. The overall duty cycle for the AC cleaning mode should generally be from 5% to 40% of the time during which photoreceptor 12 is in motion in order to achieve acceptable cleaning of charge roller 10 and acceptable life of photoreceptor 12. Generally, the lower the percentage of duty cycle, the better, and a duty cycle less than 20% is preferred. Among other factors influencing the required duty cycle are the amount of toner developed as background outside of the image area of the photoreceptor and the extent to which an untransferred and uncleaned residual toner adheres to the surface of the BCR. During the period in which the cleaning mode is active, the photoreceptor or other charge receptor should travel past the BCR at least the distance of one rotation of the BCR.

In those instances when the cleaning mode is activated for an insufficient portion of the duty cycle, a pause in the imaging mode and a switch to the cleaning mode for one rotation of BCR 10 can be used to ensure adequate cleaning of the BCR. Such an insufficient proportion of duty cycle might occur if the system is producing long running jobs and is continuously operating in the imaging mode. Alternatively to a photoreceptor rotation, the proportion of duty cycle devoted to the cleaning mode can be increased by introducing the cleaning mode during inter-document gaps if such gaps between the pitches are sufficiently large.

As taught in Nakamura et al., U.S. Pat. No. 4,851,960, uniform and adequate charging of photoreceptor 12 will occur if peak-to-peak AC voltage, $V_{p\text{-}p}$, is at least twice the charge starting voltage of the photoreceptor. It is well known to those skilled in the art that adequate cleaning will also occur if $V_{p\text{-}p}$ is twice the charge starting voltage of photoreceptor 12. Depending upon the nature of particles adhering to the BCR, $V_{p\text{-}p}$ of 1.5 times the charge starting voltage of the photoreceptor or other charge receptor in the system appears adequate. Of course, the charge starting voltage differs for the wide variety of charge receptors that various systems utilize.

Figure 4:
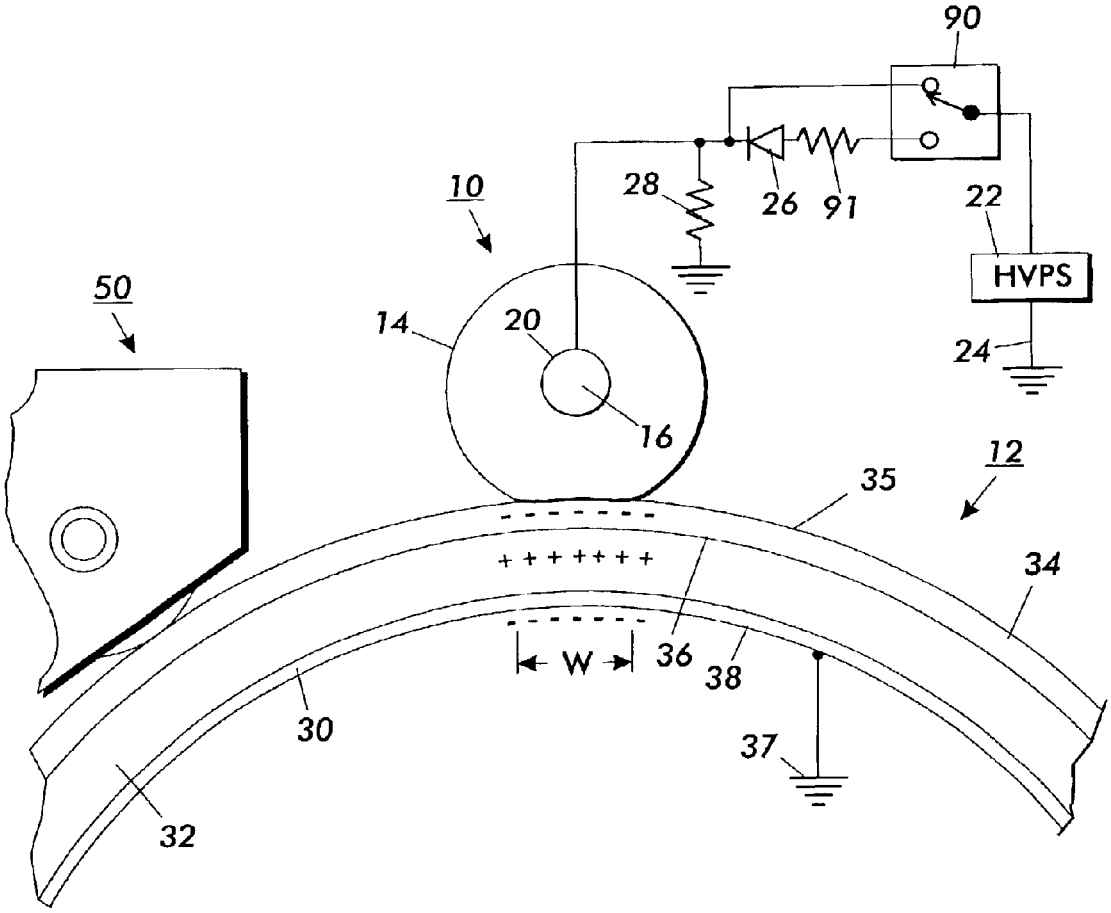
FIG. 4 is partial schematic view of a biased roll charging system in accordance with another embodiment of the present invention.

In one embodiment shown in FIG. 4, during the cleaning cycle, development of latent images upon the charge receptor 12 is suppressed in order to avoid pulling matter ejected from the BCR onto the charge receptor or into the development apparatus. Such suppression can occur by disengaging operation of development apparatus 50 during cleaning. Alternatively, the bias potential within the development field emitted by the development apparatus can be adjusted during cleaning such that $V_{bias}$ minus the charge potential of the charge receptor is sufficient to suppress toner development but insufficient to promote reverse development from the photoreceptor to the development unit. For representative organic photoreceptors, a typical range would be from 50V to 200V. Within such a range, attraction of particles ejected from the BCR to the development unit is suppressed.

In another embodiment, the cleaning apparatus of charge receptor 12 is engaged during the BCR cleaning cycle. Such cleaning apparatus may commonly comprise cleaning blades, 'fur' or insulative brushes, or electrostatic brushes. In such an embodiment, the charge receptor 12 is rotated at least sufficiently for the region of the charge receptor exposed to BCR debris to sweep through the cleaning apparatus.

In yet another embodiment, $V_{p\text{-}p}$ is increased during the AC cleaning mode. Such increase in voltage during cleaning is designed to increase the cleaning effect upon dirt, paper, and other matter to be expelled from the BCR. One simple embodiment that accomplishes this increased voltage during the AC cleaning mode is shown in FIG. 4. Here, resister 91 is inserted into the circuit with rectifier 26. One skilled in the art may elect any number of other methods for applying a greater voltage during the AC cleaning mode, including utilizing a high voltage power supply 22 with a two-level bias capability.

Another embodiment is applicable to the extent that the applied AC voltage during the cleaning mode induces strobing due to variation in charge potential by the greater voltage AC waveform. Such strobing is particularly possible if the AC $V_{p\text{-}p}$ is increased in order to increase the cleaning effect of the AC signal during the cleaning mode. In response, a complete rotation of charge receptor 12 in the DC-only mode enables all portions of the charge receptor to sweep through the DC-only corona before imaging. Alternatively, the photoreceptor may be slowed during cleaning. Another alternative is to use an erase lamp on the photoreceptor.

Each of the above embodiments may be applicable to BTR's as well as BCR's. In the case of BTR's, however, an AC cleaning mode may not be sufficient to remove all dirt and debris. Supplemental cleaning means such as, brushes may therefore be necessary. Even when such supplemental cleaning means are required, the AC cleaning mode removes much of the dirt and debris, thereby increasing the expected life of the supplemental cleaning means and decreasing maintenance cost and efforts.

In review, the foregoing description discloses an apparatus for applying an electrical charge to a photoreceptor wherein a bias contact roll member is situated in contact with a surface of member to be charged such as, a photoreceptor. The bias contact roll member is supplied with an electrical bias having at least two operating modes. In a first mode, an oscillating voltage signal is clipped to remove a predetermined polarity component thereof. In a second mode, the oscillating voltage signal is not clipped, and a signal comprising multiple polarities is applied to the contact roll member. In this manner, the improved durability advantages of a clipped single polarity waveform can be realized as well as the cleaning advantages of a multiple polarity waveform.

It is, therefore, apparent that there has been provided, in accordance with the present invention, a roll charging device that fully satisfies the aims and advantages set forth hereinabove. While particular embodiments have been described, alternatives, modifications, variations, improvements, and substantial equivalents that are or may be presently unforeseen may arise to applicants or others skilled in the art. Accordingly, the appended claims as filed and as they may be amended, are intended to embrace all such alternatives, modifications variations, improvements, and substantial equivalents.

What is claimed is:

1. An apparatus for applying an electrical charge to a member to be charged, comprising:

a power supply for supplying an oscillating voltage signal;

a charge roll member situated in proximity to a surface of the member to be charged; and a switch for switching between a plurality of modes wherein:

a) in a first mode, an electrical bias is applied from the power supply to the charge roll member, the electrical bias including a single polarity input drive voltage to said charge roll member, said voltage signal comprising an oscillating voltage signal that is clipped to remove a selected polarity; and b) in a second mode, an electrical bias is applied from the power supply to the charge roll member, the electrical bias including an oscillating voltage signal containing multiple polarity components in order to supply oscillating polarity input drive voltage to the charge roll member.

2. The apparatus of claim 1, wherein the charge roll member is a bias transfer roller.

3. The apparatus of claim 1, wherein in the first mode, the power supply supplies an oscillating polarity component combined with a DC offset component in order to apply an electrical bias of a single polarity.

4. The apparatus of claim 1, wherein the second mode is selected during non-imaging periods.

5. The apparatus at claim 1, wherein the second mode is selected during system warm-up cycles.

6. The apparatus of claim 1, wherein the second mode is selected on during shutdown procedures.

7. The apparatus of claim 1, wherein the peak-to-peak oscillating polarity drive voltage during a period in which the second mode is selected exceeds twice the charge starting voltage of the member to be charged.

8. The apparatus of claim 1, wherein the peak-to-peak oscillating voltage during a period in which the second mode is selected exceeds 1.5 times the charge starting voltage of the member to be charged.

9. The apparatus of claim 8, wherein the oscillating polarity drive voltage is applied for at least one revolution of the charge roll member.

10. The apparatus of claim 1, wherein the oscillating drive voltage during a period when the second mode is selected exceeds the drive voltage during periods when the first mode is selected.

11. The apparatus of claim 10, further comprising a resister element coupled between the power supply and the charge roll member during a period in which the first mode is selected.

12. The apparatus of claim 1, further comprising a mechanism for rotating the member to be charged and wherein, upon transition from the second mode to the first mode, the mechanism for member rotation is activated for at least one revolution of the member to be charged.

13. The apparatus of claim 1, further comprising an apparatus for cleaning the member to be charged wherein said cleaning apparatus is engaged before imaging for cleaning from the member to be charged residue extracted from the charge roll member during periods when the second mode is selected.

14. The apparatus of claim 1, further comprising an image development apparatus for developing an image on the member to be charged wherein development of images is suppressed during periods when the second mode is selected.

15. An apparatus for applying an electrical to a member to be charged comprising:

a power supply for supplying an oscillating voltage signal;

a charge roll member situated in proximity to a surface of the member to be charged; and a switch for switching between a plurality of modes wherein:

a) in a first mode, an electrical bias is applied from the power supply to the charge roll member, the electrical bias including a single polarity input drive voltage to said charge roll member; and b) in a second mode, an electrical bias is applied from the power supply to the charge roll member, the electrical bias including an oscillating voltage signal containing multiple polarity components in order to supply oscillating polarity input drive voltage to the charge roll member, wherein the second mode is selected during a period ranging from 5% to 40% of the time during which the member to be charged is moving.

16. An apparatus for applying an electrical charge to a member to be charged, comprising:

a power supply for supplying an oscillating voltage signal;

a charge roll member situated in proximity to a surface of the member to be charged; and a switch for switching between a plurality of modes wherein:

a) in a first mode, an electrical bias is applied from the power supply to the charge roll member, the electrical bias including a single polarity input drive voltage to said charge roll member; and b) in a second mode, an electrical bias is applied from the cower supply to the charge roll member, the electrical bias including an oscillating voltage signal containing multiple polarity components in order to supply oscillating polarity input drive voltage to the charge roll member, wherein the second mode is selected during periods comprising less than 20% of the time during which the member to be charged is moving.

17. An apparatus for applying an electrical charge to a member to be charged, comprising:

a power supply for supplying an oscillating voltage signal;

a charge roll member situated in proximity to a surface of the member to be charged;

a switch for switching between a plurality of modes wherein:

a) in a first mode, an electrical bias is applied from the power supply to the charge roll member, the electrical bias including a single polarity input drive voltage to said charge roll member; and b) in a second mode, an electrical bias is applied from the power supply to the charge roll member, the electrical bias including an oscillating voltage signal containing multiple polarity components in order to supply oscillating polarity input drive voltage to the charge roll member; and an image development apparatus for developing an image on the member to be charged wherein development of images is suppressed during periods when the second mode is selected and wherein the development apparatus generates an electrical development field having a bias voltage wherein suppression of development of images is achieved by increasing the development field bias voltage.

18. An electrophotographic imaging system, comprising:

an apparatus for applying an electrical charge to a member to be charged, said charging apparatus, comprising:

a power supply for supplying an oscillating voltage signal; a charge roll member situated in proximity to a surface of the member to be charged; and a switch for switching between a plurality of modes wherein:

a) in a first mode, an electrical bias is applied from the power supply to the charge roll member, the electrical bias including a single polarity input drive voltage to said charge roll member; and b) in a second made, an electrical bias is applied from the power supply to the charge roll member, the electrical bias including an oscillating voltage signal containing multiple polarity components in order to supply oscillating polarity input drive voltage to the charge roll member, said voltage signal comprising an oscillating voltage signal that is clipped to remove a selected polarity.

19. The apparatus of claim 18, wherein the electrophotographic imaging system undergoes procedures related to system warm-up, system shut-down, end of an imaging sequence, and system idleness for specified periods; and wherein the second mode is selected for timed periods triggered by system events selected from the group consisting essentially of system warm-up, system shut-down, end of an imaging sequence, and system idleness for specified periods.

20. The apparatus of claim 18, further comprising an image development apparatus for developing an image on the member to be charged wherein development of images is suppressed during periods when the second mode is selected.

21. The apparatus of claim 20, wherein the development apparatus generates an electrical development field having a bias voltage wherein suppression of development of images is achieved by increasing the development field bias voltage.

22. A process for applying an electrical charge to a member to be charged, comprising:

a. supplying an oscillating voltage signal from a power supply;

b. positioning a charge roll member proximately to a surface of the member to be charged; and c. selecting between a plurality of modes, wherein:

in the first mode, an electrical bias is applied from the power supply to the charge roll member, the electrical bias including a single polarity input drive voltage to said charge roll member, said voltage signal comprising an oscillating voltage signal that is clipped to remove a selected polarity; and in a second mode, an electrical bias is applied from the power supply to the charge roll member, the electrical bias including an oscillating voltage signal containing multiple polarity components in order to supply oscillating polarity input drive voltage to the charge roll member.

* * * * *